US005207634A

United States Patent [19]

Greenstein

[11] Patent Number: 5,207,634

[45] Date of Patent: May 4, 1993

[54] SELF-BALANCING APPARATUS AND METHOD FOR A CENTRIFUGE DEVICE

[75] Inventor: Alan P. Greenstein, Seattle, Wash.

[73] Assignee: Biotope, Inc., Redmond, Wash.

[21] Appl. No.: 645,106

[22] Filed: Jan. 23, 1991

[51] Int. Cl.[5] ..... B04B 9/14

[52] U.S. Cl. ..... 494/10; 494/16; 494/82; 494/84; 73/470

[58] Field of Search ..... 494/1, 7, 10, 16, 82, 494/84; 364/463, 498, 506, 508, 550, 565; 73/468, 470

[56] References Cited

U.S. PATENT DOCUMENTS

| | | | |
|---|---|---|---|
| 2,895,766 | 7/1959 | Leopold | 73/470 |
| 3,692,236 | 9/1972 | Livshitz | 494/37 |
| 4,039,288 | 8/1977 | Moran | 422/67 |
| 4,238,960 | 12/1980 | Curtis | 364/508 |
| 4,711,610 | 12/1987 | Riehl | 74/573 R |
| 5,030,418 | 7/1991 | Miyata | 422/65 |

FOREIGN PATENT DOCUMENTS

| | | | |
|---|---|---|---|
| 2908272 | 9/1980 | Fed. Rep. of Germany | 73/468 |
| 3742149 | 6/1989 | Fed. Rep. of Germany | 494/82 |
| 1050753 | 10/1983 | U.S.S.R. | 494/82 |

OTHER PUBLICATIONS

Clinical Chemistry, vol. 31, No. 9, 1985 *Two-Dimensional Desk-Top Clinical Chemistry*, Steven G. Schultz, James T. Holen, Joseph P. Donohue, and Therese A. Francoeur.

*Primary Examiner*—Philip R. Coe
*Assistant Examiner*—Randall E. Chin
*Attorney, Agent, or Firm*—Seed and Berry

[57] ABSTRACT

A self-balancing apparatus for a centrifuge is disclosed which employs two arcuately movable counterweights. The centrifuge has a plurality of receptacles for receiving one or more assay cartridges. Control apparatus in the centrifuge determines the location and number of received cartridges. Desired counterweight positions are then calculated which will substantially balance the centrifuge. The counterweights are moved into these positions prior to the centrifuge being operated at high speeds.

13 Claims, 5 Drawing Sheets

FIG. 1
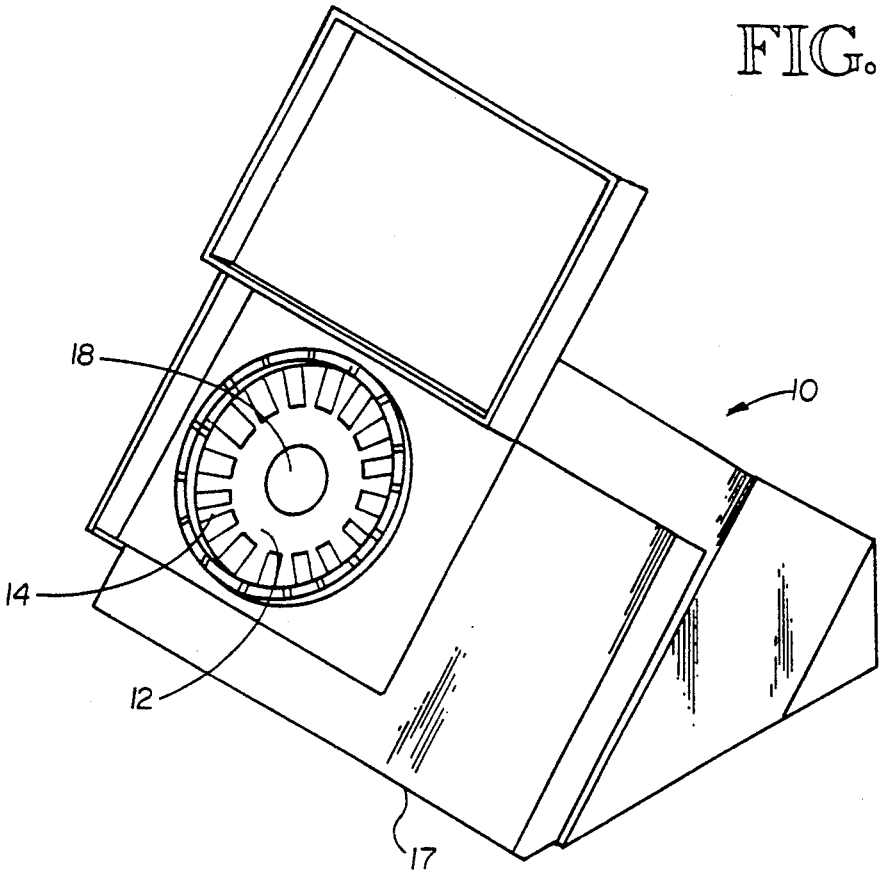
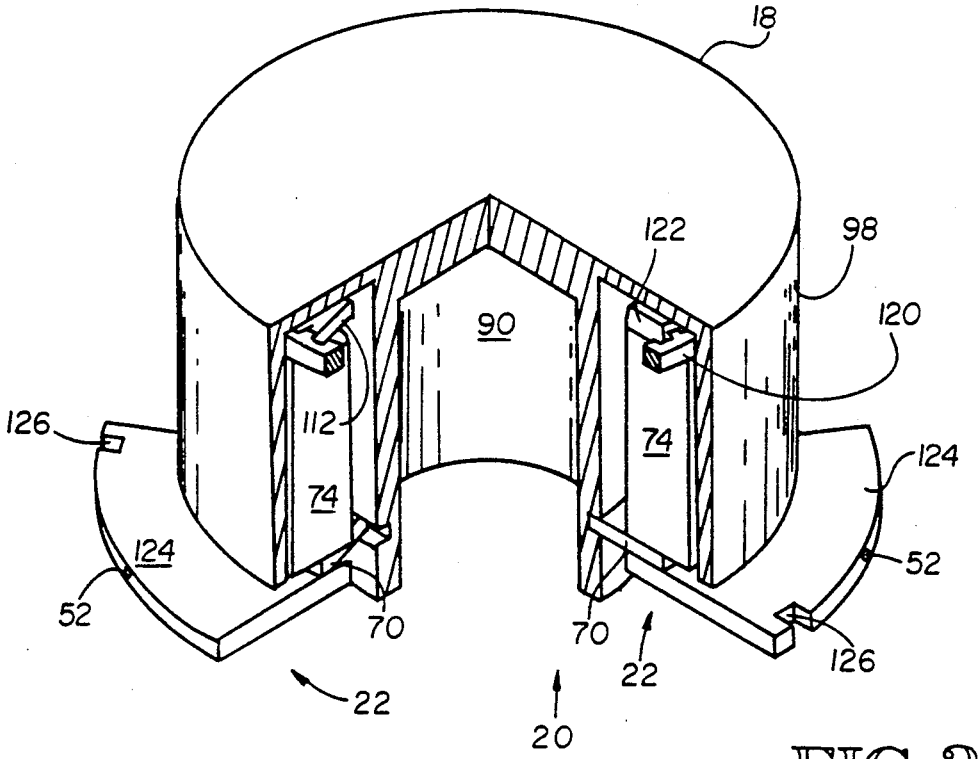
FIG. 3

FIG. 7
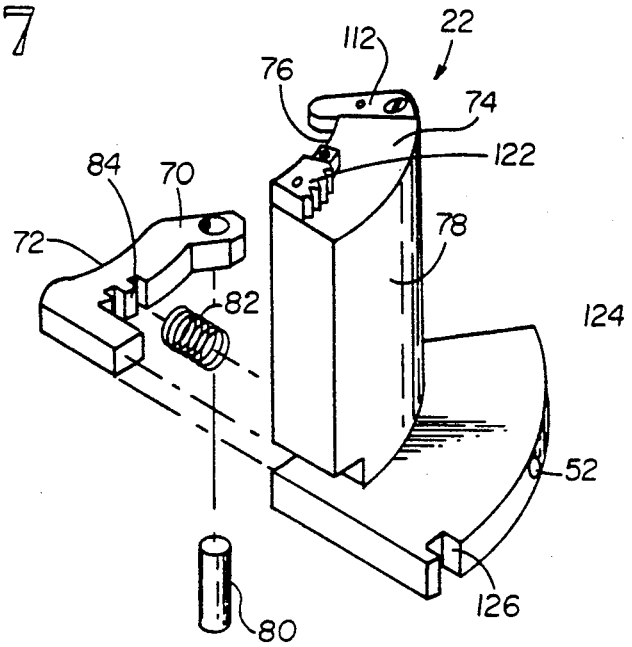
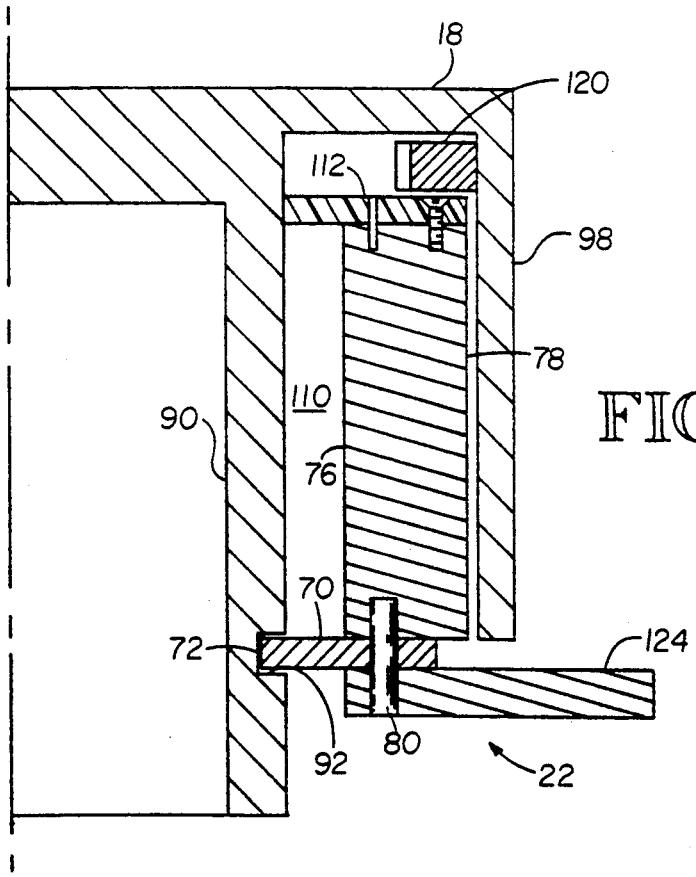
FIG. 8

SELF-BALANCING APPARATUS AND METHOD FOR A CENTRIFUGE DEVICE

DESCRIPTION

1. Technical Field

The invention relates to methods and apparatus for balancing a rotating device. More specifically, the invention relates to methods and apparatus for self balancing a centrifuge rotor or platter which is adapted to receive one or more assay cartridges.

2. Background of the Invention

Automated patient sample analysis devices have been developed to run various tests or "assays" for the detection of various biological substances and determination of various biological quantities. Fully-automated apparatus of this type typically employ a rotor or platter for receiving one or more cassettes or cartridges containing the necessary chemical reagents for analyzing a patient's sample, typically human blood, blood plasma, or blood serum. It is often necessary to separate whole blood cells from their blood plasma or serum medium so that subsequent reaction of the plasma with various reagents can proceed. Such a separation step often involves spinning a platter or rotor at a high speed, up to 10,000 RPM, to achieve the desired centrifugal force which separates the whole blood cells from the blood plasma. After such separation has been achieved, the plasma may then react with various reagents to produce, for example, conjugates having optically detectable labels or labels detectable by other means. Detection and quantification of the labels are thus indicative of a biological quantity to be recorded.

Often, incubation and agitation of the separated plasma with the suitable reagents are necessary steps in performing the assay. Precise control of assay cartridge temperature, agitation magnitude, and agitation time may be necessary to achieve repeatable assay results. It is therefore highly desirable to control the degree of agitation to which such cartridges or cassettes are subject to provide consistent test results. It is also desirable for purposes of efficiency to process one or more cartridges, each containing samples from different patients, simultaneously. Assuming that the rotor itself is balanced about its rotation axis, and further assuming that receptacles for the cartridges are positioned at regular angular intervals about the rotation axis, the rotor will remain dynamically balanced as long as a cartridge is received in each cartridge receptacle on the rotor, or as long as multiple cartridges are distributed symmetrically around the rotor. However, in a clinical setting it may be desirable to operate the analysis instruments with less than a full load of cartridges for the rotor. In this case, the rotor will not remain balanced unless "dummy" cartridges are inserted into the empty receptacles of the rotor, or when the cartridges are symmetrically distributed by the instrument operator, which may be impossible due to the fixed spatial relationship of the cartridge receptacles. In the absence of providing "dummy" cartridges or some other means for balancing the rotor, undesirable vibrations can develop which may interfere with the performance of the assays. For example, consider a rotor having a plurality of receptacles for assay cassettes, and further assume that each cassette weights approximately 10 g when loaded with the appropriate reagents and patient sample. Assume further that the center of mass of the cassette is positioned 9 cm from the rotation axis. At 5,000 RPM, the radial force exerted by the cassette on the rotor is approximately 55 lbs. If this force is not balanced by a counterforce, vibrations may develop which will undesirably agitate the received cassettes in an uncontrolled and unanticipated manner. In addition, the vibrations may detrimentally effect the structural integrity of the analysis device.

To overcome the above-described difficulties, at least one automated patient sample instrument manufacturer has introduced a passive system for counterbalancing a rotor having a plurality of cassette receptacles. As described in *Clinical Chemistry* 31(9), 1985, a two-dimensional centrifugation system for desktop clinical chemistry is described which employs a rotor having a plurality of receptacles for assay cassettes. The receptacles are positioned at the periphery of a rotor at regularly spaced angular intervals. Associated with each receptacle is a weight which slides on a radially-directed track. The weight is biased to move inwardly towards the center of rotation when the rotor is not rotated. At high rotational speeds, the weights move radially outward under centrifugal force to provide a larger centrifugal force on the rotor than at times when the weight is positioned radially inward. When a cassette is received in a cassette receptacle, a mechanism prevents the weight from sliding outwardly. Although this device suitably suppresses undesirable vibrations in the apparatus by counterbalancing the rotor, this device requires that a sliding weight, spring bias mechanism, and associated locking device be provided for each receptacle of the rotor. Such a system is expensive to manufacture and undesirably reduces the reliability of the counterbalancing technique because each of the counterbalancing devices for each cassette receptacle must operate properly for the rotor to be counterbalanced.

Various techniques are known for balancing shafts on high speed rotating equipment. These techniques often involve the rotational movement of two or more lopsided or elliptical cams with respect to the shaft rotation axis in response to vibrations developed in the shaft. Such devices typically employ a vibration sensor which detects the magnitude of shaft vibrations. The cams are then rotated until the vibrations subside. Such a system is inapplicable to a patient sample testing instrument described above because it is necessary to prevent undesirable vibrations before they occur to ensure that the assay cassettes do not receive any agitation in addition to the programmed agitation which may be provided by the test instrument.

Therefore, a need exists for a self-balancing apparatus for a rotating centrifuge which utilizes a minimum number of moving parts, which is relatively inexpensive to manufacture, and which balances the rotor prior to high speed centrifugation of the cassettes.

SUMMARY OF THE INVENTION

It is an object of the present invention to provide a self-balancing apparatus for a rotor on an analytic instrument which automatically balances the rotor regardless of the number or location of assay cassettes which are received in the rotor.

It is another object of the present invention to achieve the above object with a device which has a minimum number of moving parts and which is relatively simple to manufacture.

It is yet another object of the present invention to provide a method for balancing a rotor which balances the rotor without requiring high speed rotation thereof, which would undesirably affect performance of the assays in the assay cassettes.

The present invention achieves these objects, and other objects and advantages which will become apparent from the description which follows, by providing a self-balancing apparatus and technique which employs two arcuately movable counterweights which can be connected to the rotor or platter which is adapted to receive a plurality of assay cassettes or cartridges. The device determines the number and positions of cartridges which have been received in the rotor or platter. A desired position for the counterweights with respect to the platter or rotor is then calculated and the counterweights are moved with respect to the platter to the desired, counterbalancing positions. The rotor is then prepared to rotate at desired speeds for performing the assays of interest.

In its preferred embodiment, the self-balancing apparatus has two counterweights of substantially equal mass which are adapted for arcuate movement with respect to the rotor. The counterweights are provided with engagement/disengagement mechanisms which alternately engage and disengage the counterweights with respect to a frame member and with respect to the rotor. When the counterweights are engaged to the frame, and disengaged from the rotor, movement of the rotor with respect to the frame repositions the counterweights with respect to the rotor. Once the counterweights have been repositioned at their desired, counterbalancing positions, the counterweights are reengaged with the rotor and disengaged from the frame. The rotor is then counterbalanced and prepared for rotation at high speeds.

To determine the desired counterbalancing position of the counterweights, the apparatus first determines the number and position of assay cassettes loaded into the rotor. Desired angular positions for each of the counterweights relative to the locations of the received cartridges are then calculated, and the counterweights are moved with respect to the rotor to the desired angular positions. The rotor is thus counterbalanced for subsequent rotation of the same at a desired speed for centrifuging and processing the cartridges without undesirable vibrations.

BRIEF DESCRIPTION OF THE DRAWINGS

FIG. 1 is an isometric view of a patient sample analysis instrument having a rotor for receiving a plurality of assay cartridges.

FIG. 3 is a partial isometric view of the rotor hub.

FIG. 7 is an isometric, exploded view of a counterweight of the invention.

FIG. 8 is a partial, sectional, side elevational view of the rotor hub taken along line 8—8 of FIG. 6.

DETAILED DESCRIPTION OF THE INVENTION

Figure 2:
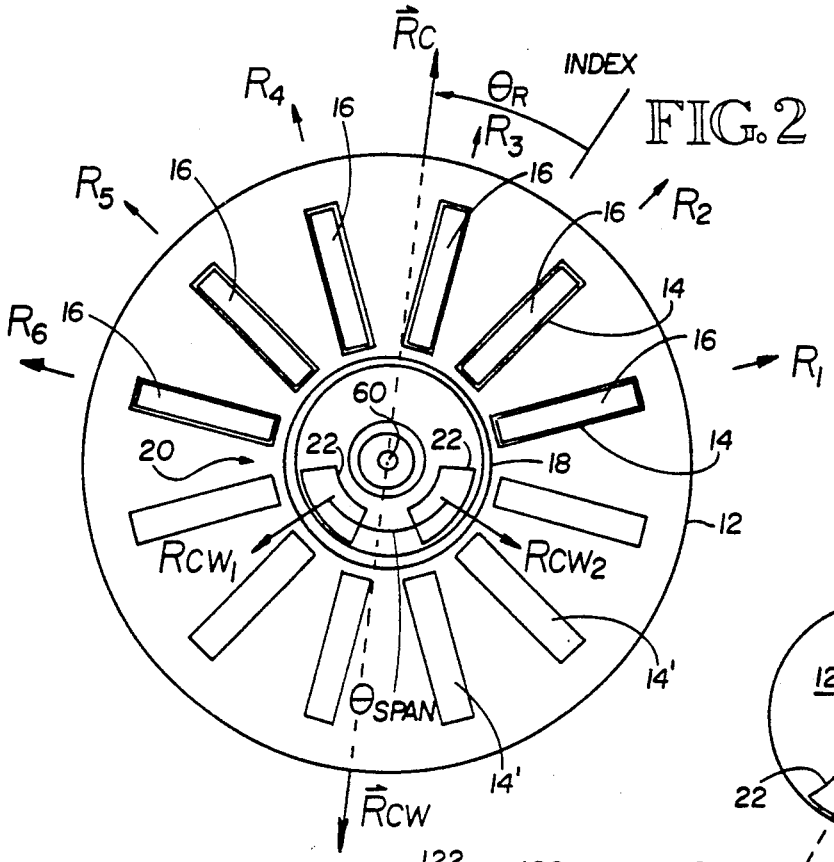
FIG. 2 is a top plan view of the rotors shown in FIG. 1.

An automated patient sample analysis instrument employing a self-balancing apparatus and method of the present invention, is generally indicated at reference numeral 10 of FIG. 1. The instrument is adapted to perform fully-automated processing of a variety of assay cartridges or cassettes, such as those described in copending U.S. patent application Ser. No. 07/387,917 entitled "Biological Assay Cassette and Method for Making Same," assigned to the assignee of the present invention and filed on Jul. 31, 1989, the disclosure of which is incorporated herein by reference. For the purposes of this disclosure it is sufficient to understand that the cassettes incorporate a fully self-contained chemical and biological system for performing an assay involving a patient sample such as blood, blood plasma, or blood serum. The patient sample is introduced at one end of the cartridge, then centrifuged to promote movement of the sample through various axially-directed chambers or layers in the reaction cassette until a complete reaction has occurred at a bottom end of the cassette. This bottom end of the cassette is then photometrically analyzed to determine a relevant quantitative measurement indicative of a biological reaction. It is to be understood that the analysis instrument itself is capable of processing assay cartridges of various different types which may be presently available or which may be developed in the future.

The automated patient sample analysis instrument 10 is substantially similar to the device described in copending U.S. patent application Ser. No. 07/387,910 filed Jul. 31, 1989 entitled "Method and Apparatus for Measuring Specific Binding Assays," assigned to the assignee of the present invention, the disclosure of which is incorporated herein by reference. Generally speaking, the instrument is provided with a rotating platter or rotor 12 having a plurality of assay cassette receptacles 14 for receiving the assay cassettes described above. The apparatus is provided with control mechanisms generally shown in FIG. 9 for reading the cassettes, centrifuging the cassettes, incubating the cassettes, and agitating the cassettes to perform the desired assays within the cartridges under controlled conditions. The rotor is preferably provided with 16 such receptacles, but may be provided with 12 receptacles as shown in FIG. 2, or more or less receptacles as desired.

As previously stated, the assay cartridges are processed by a technique employing centrifugal force, incubation, and agitation under controlled conditions of magnitude and duration. One aspect of providing a suitable instrument for this purpose involves mimimizing undesirable, inconsistent vibrations which may otherwise be transferred to the cassettes due to an imbalance in the rotor 12 when loaded with a non-symmetrical distribution of cassettes. FIG. 2 illustrates such a situation where cassettes 16 have been loaded into six adjacent receptacles 14 while the remaining six adjacent receptacles 14' are unloaded. This maldistribution causes a substantial dynamic imbalance in the rotor, which may spin at speeds up to 10,000 PRM for certain assays. As an example of the imbalanced forces which can be generated on the rotor 12, consider a single cassette having a mass of approximately 10 g with the center of mass positioned 9 cm from the rotor center. At 5,000 RPM, the radial force exerted by this cassette on the rotor is 55 lbs. The total imbalance caused by six cassettes, as shown in FIG. 2, is substantially greater.

In order to compensate for the potential imbalances caused by a non-symmetrical distribution of cassettes received in cassette receptacles 14, the rotor 12 is provided with a counterweight mechanism generally indicated at reference numeral 20 in FIGS. 2 and 3.

The counterweight mechanism 20 includes two counterweights 22 which are arcuately movable with respect to the rotor 12. As is described further hereinbelow, the counterweights are alternately engageable and disengageable with the hub 18 of the rotor, and with the frame 17 of the analysis instrument 10. To move the counterweights 22 towards desired, individual counterbalancing positions, a counterbalancing position for each counterweight 22 is calculated according to the number and position of cassettes 16 received in cassette receptacles 14'. The counterweights 22 are then individually disengaged from rotor 12, as will be described further hereinbelow, and are engaged with the frame. The rotor 12 is then rotated, as described further hereinbelow to a relative position with respect to the counterweight such that the counterweight is positioned in the desired counterbalancing position. The counterweight is then disengaged from the frame 17 of the instrument 10 and re-engaged with the rotor 12. This procedure is also followed for the second counterweight. The instrument is then ready to process the received cassettes 16 at high rotational speeds without any significant imbalance of the rotor imparting undesired vibrations to the cassettes or to the supporting structure, bearings, etc. of the instrument.

Figure 9:
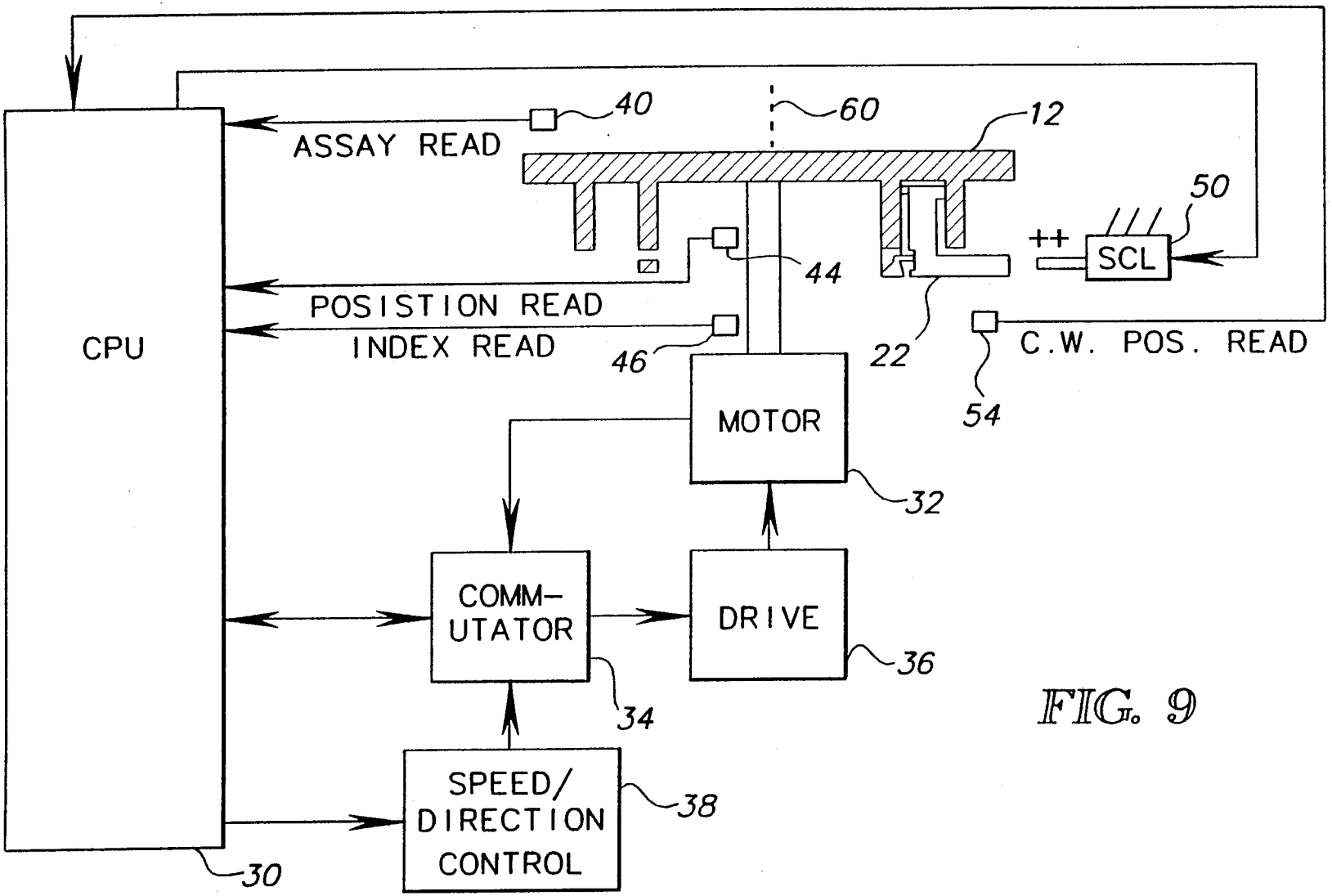
FIG. 9 is a schematic diagram of a control system for a rotor drive mechanism and a counterweight movement mechanism.

As shown in FIG. 9, the instrument 10 is provided with a control system including a microprocessor 30 which is programmed to operate the instrument as described hereinbelow. A suitable microprocessor is a Zilog model Z-180 manufactured by Zilog, Inc., of Campbell, Calif. The rotor 12 is driven by a motor, such as a 3-pole brushless direct current motor 32. The microprocessor 30 controls the motor through a conventional commutator 34 and associated drive circuit 36. A motor controller, illustrated as speed control circuit 38, utilizes pulse width modulation to control the speed of the motor under direction from the microprocessor 30.

The speed of the rotor 12 is programmed to vary from a low speed for reading data encoded on the cassettes to a high speed of up to 10,000 RPM for centrifuging. The cassette data may be encoded on the cassette cartridges 16 such as by a bar code. The bar code on the cartridges is read by an optical detector/emittor pair of the conventional type indicated at reference numeral 40 to determine the number of cassettes and to read the cassette data. The microprocessor is also programmed to rotate the rotor at a very low speed to incubate and agitate cartridges received in the rotor. Agitation is achieved by modulating the speed and direction of the rotor through the drive circuit 36.

The position and speed of the rotor 12 is monitored by a second emittor/detector pair 44 positioned on the motor 32. A third emittor/detector pair 46 on the motor serves as an index locator to determine a "12 o'clock" or index position for the rotor 12. All of the emittor/detector pairs are operatively coupled to the microprocessor 30. A suitable encoder incorporating the second and third emittor/detector pairs is available from Hewlett-Packard, Corp., Palo Alto, Calif. As is apparent from the above, and from the schematic shown in FIG. 9, the position of the rotor 12, the number and position of cassettes received in the cassette receptacles 14, and the direction of rotation of the rotor 12 are known by the microprocesor 30. In order to appropriately position the counterweights 22 with respect to the rotor 12, the positions of the counterweights must at some point be known so that the appropriate relative positioning of the counterweights and rotor can be achieved. For this purpose, the instrument 10 is provided with a solenoid 50 shown in FIGS. 4–6 and 9, which is operated by the microprocessor 30. The solenoid is fixed to the frame 17 of the instrument. The solenoid has the ability, as is described hereinbelow, to decouple the counterweights 22 from the rotor 12 and fix the position of the counterweights at the location of the solenoid 50 with respect to the frame.

In order to determine when the counterweights 22 are in a position so as to be capturable by the solenoid 50, the counterweights are provided with an embedded magnet 52. The magnet 52 actuates a Hall effect sensor 54 so as to inform the microprocessor 30 when a counterweight 22 is in the capturable position. The located counterweight 22 is then fixed with respect to the frame 17 by activation of the microprocessor-controlled solenoid 50 and the rotor 12 is rotated under microprocessor control until the counterweight is positioned in the desired, counterbalancing position with respect to the rotor. At that time, the microprocessor 30 instructs the solenoid 50 to release the counterweight, allowing the counterweight to re-engage the rotor for rotation therewith. This process is repeated with the second counterweight until both counterweights are in the desired, counterbalancing positions in accordance with the calculations performed by the microprocessor.

The method for calculating the desired, counterbalancing positions for the counterweights is described as follows. As stated above, the microprocessor 30 first reads the number and relative positions of the cassettes 16 received in the cassette receptacles 14 of the rotor 12. A bar code on the cassette advises the microprocessor of the type of assay in the cassette. The microprocessor has in its memory information relating to the mass of that particular cassette type and the center of mass distance of that particular cassette type from the rotation axis of the rotor. The microprocessor then knows the approximate mass (usually in the range of 10 g to 15 g) of the cassettes and calculates a resultant mass-moment vector for all of the cassettes. This vector is directed radially outwards from the center of the rotor and has a magnitude equal to the product of the center of mass distance of the cassettes when received in the cassette receptacles from the rotation axis 60 of the rotor and the mass of the cassette. The microprocessor calculates the magnitude of the resultant mass-moment vector by summing the orthogonal magnitude components of each cassette. Specifically, one set of components is equal to the sum of the mass of each cassette times the cosine of the angle its individual mass-moment vector forms with the index position (i.e., 12 o'clock) of the rotor. The transverse mass-moment component of each cassette mass-moment vector is equal to the mass of the cassette multiplied by the sine of its angle with respect to the index position. The angle of the resultant vector is merely the arc tangent of the ratio between the orthogonal components of the individual mass-moment vectors of each cassette as described below:

$$R_{cx} = \sum_{\text{all cassettes}} M_c \text{COS}\theta_c \quad (1)$$

$$R_{cy} = \sum_{\text{all cassettes}} M_c \text{SIN}\theta_b$$

where $R_{cx}$ and $R_{cy}$ are the magnitudes of the transverse components of the individual mass-moment vectors; $M_c$ is the product of a cassette mass and its center of mass distance from the rotation axis 60; and $$\theta_R = \text{TAN}^{-1}(R_{cy}/R_{cx}), \quad (2)$$

where $\theta_R$ is the angular position of the cassette resultant mass-moment vector measured with respect to an index position.

Figure 2A:
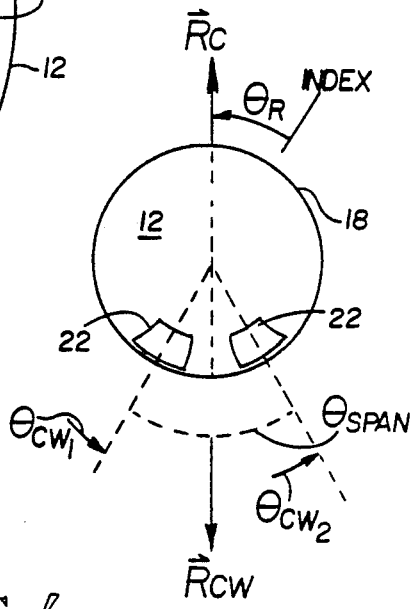
FIG. 2*a* is a free body diagram illustrating various vector components associated with calculating desired, counterbalancing positions for counterweights of the invention.
Figure 4:
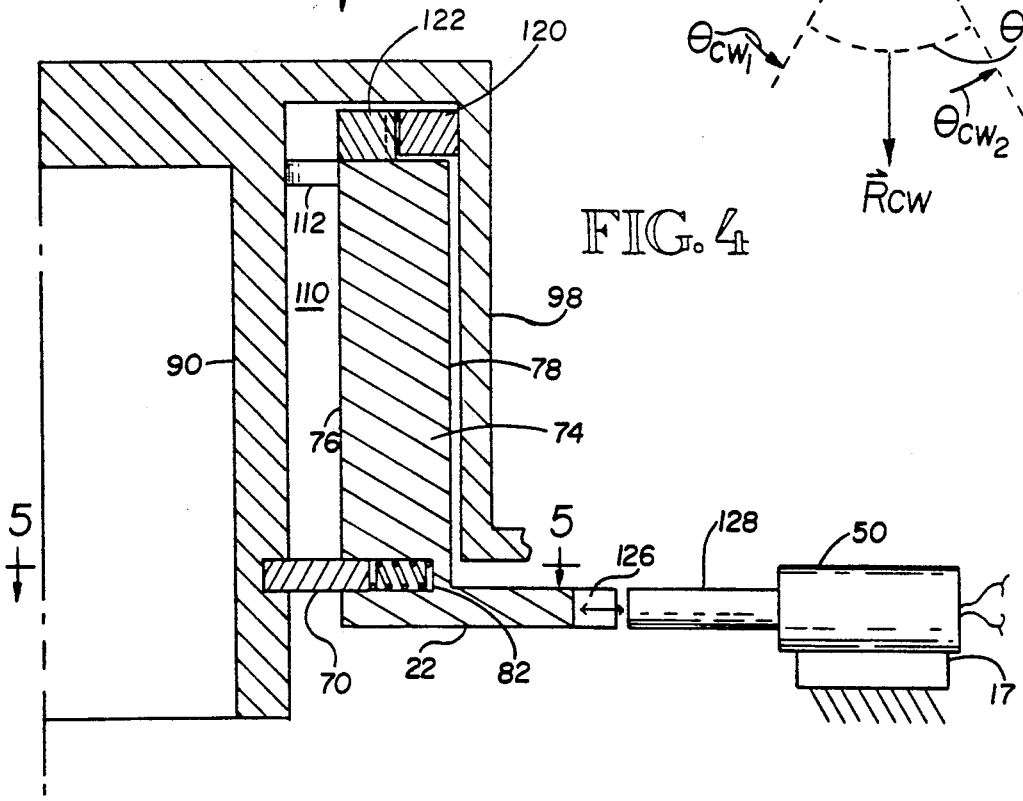
FIG. 4 is a partial, sectional side elevational view of the rotor hub taken along the lines 4—4 of FIG. 5.

As best understood by reference to FIGS. 2 and 2a, the counterweights 22 are moved arcuately with respect to the rotor 12 within the hub 18 as described above, so that a bisector of their respective radial mass-moment vectors is diametrically opposed to the position of the cassette resultant mass-moment vector $R_c$. The mass of the counterweights is known (approximately 146 g each) as is their radial center of mass distance from the rotation axis 60 of the rotor 12 (approximately 2.9 cm). To determine the desired, counterbalancing positions of each counterweight, it should be remembered that one component of each of the counterweight, mass-moment vectors will cancel its mirror image with respect to the remaining counterweight because the counterweights are always moved an equal arcuate distance away from the desired, resultant counterweight mass-moment vector which is diametrically opposed to the resultant cassette mass-moment vector. If the radial distance between the center of masses of each counterweight is defined as $\theta_{span}$ (see FIG. 2), then the magnitude of the resultant mass-moment vector contributed by both counterweights is twice the mass of each counterweight multiplied by the cosine of $(\frac{1}{2}\theta_{span})$ as stated below:

$$R_{cw} = 2M_{cw} \text{COS}\,(\theta_{span}/2) \quad (3)$$

where $R_{cw}$ equals the magnitude of the resultant moment from the non-cancelling component of each counterweight, and where $M_{cw}$ equals the mass of each counterweight times its center of mass distance from the rotation axis of the rotor. Then $$\theta_{span} = 2\,\text{COS}^{-1}(R_{cw}/2M_{cw}), \textit{ and;} \quad (4)$$

$$\theta_{cw1} = \theta_R + 180° - \tfrac{1}{2}\theta_{span}$$

$$\theta_{cw2} = \theta_R + 180° + \tfrac{1}{2}\theta_{span},$$

where $\theta_{cw1}$ equals the desired radial position of the first counterweight with respect to the index position and where $\theta_{cw2}$ equals the desired, counterbalancing position of the second counterweight 22.

The specific structure of the counterweights 22 and the mechanisms by which they are engageable and disengageable with respect to the rotor 12 are best understood with reference to FIGS. 3–8. As shown in FIG. 8, each counterweight 22 has an inner portion 70 having an arcuate inner surface 72 and an outer portion 74 having an arcuate inner surface 76 and an arcuate outer surface 78. The inner portion 70 and outer portion 74 are pivotally connected together by a pin 80. A coil spring 82 is compressed between a receiving seat 84 on the inner portion 70 and a corresponding receiving seat 86 on the outer portion so as to bias the inner and outer portions away from one another.

As shown in FIG. 8, the rotor hub 18 has an inner, downwardly directed cylindrical flange 90 defining an outwardly directed circumferential groove 92 for receiving the arcuate inner surface 72 of the inner portion 70 of the counterweight 22. The groove is sized so as to be slightly larger than the inner portion 70 so as to slidingly receive the same. The hub 18 also has an outer, downwardly directed cylindrical flange 98 which is spaced radially outward from the inner flange 90 so as to define an open-ended annular cavity 110 for receiving the outer portion 74 of the counterweight 22. The outer portion 74 of the counterweight has a thickness between its arcuate inner and outer surfaces 76, 78 which is less than the radial dimension of the annular cavity 110 so that the counterweight 22 can move circumferentially within the annular cavity. The counterweight is vertically supported by the inner portion 70 which rides in the circumferential groove 92. The upper end of the outer portion 74 is provided with a plastic guide member 112 having a length which is substantially equal to the radial dimension of the annular cavity 110 to laterally support and guide the counterweight 22 within the annular cavity.

Figure 5:
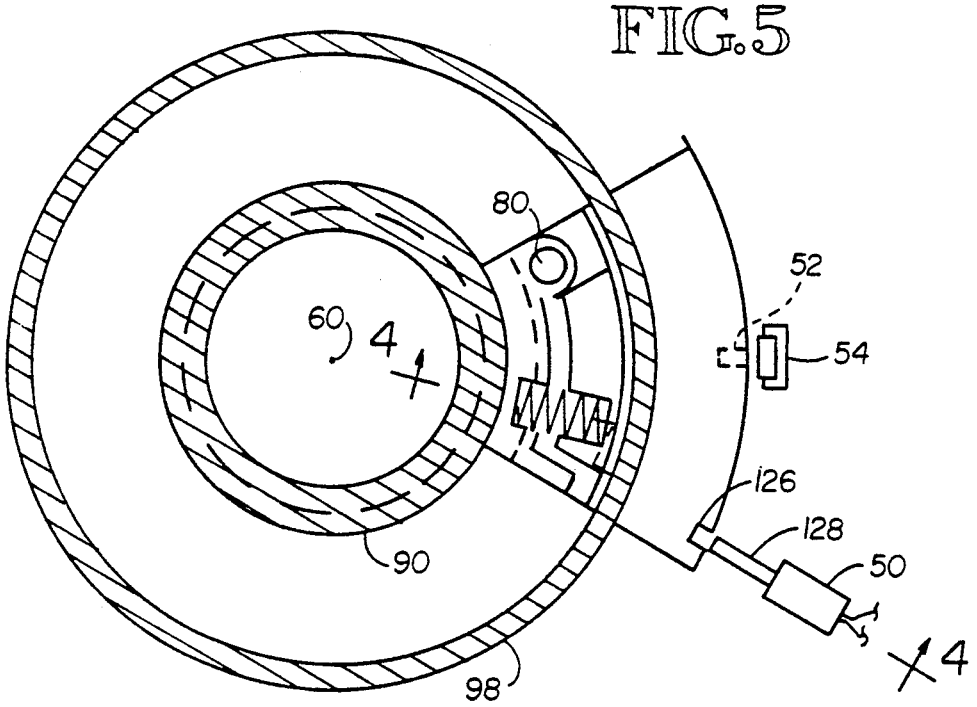
FIG. 5 is a sectional, top view of the rotor hub taken along line 5—5 of FIG. 4 with one of the counterweights shown in an engaged position with the rotor hub.
Figure 6:
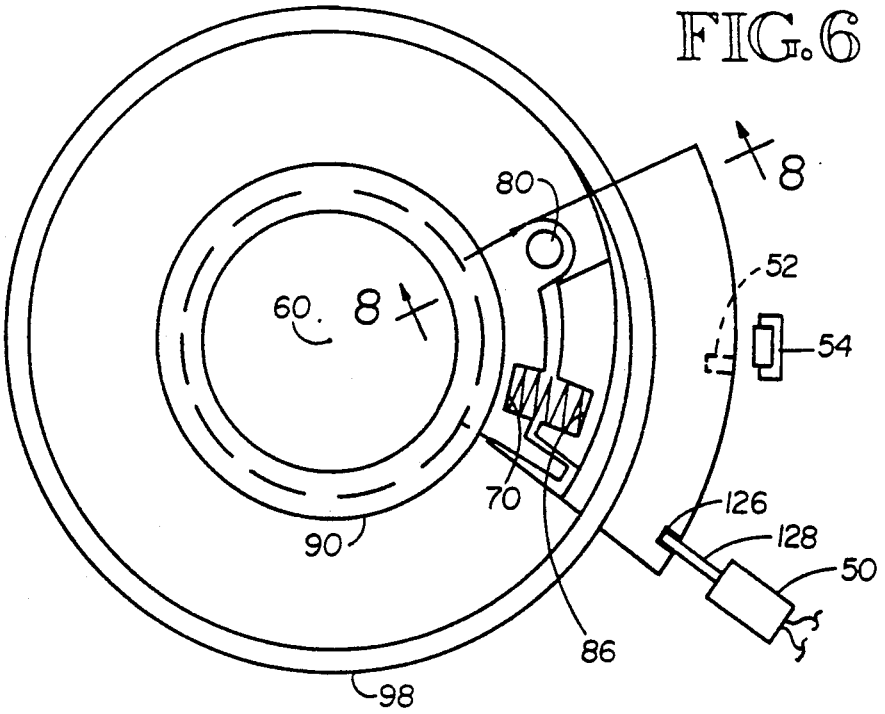
FIG. 6 is a sectional, top view similar to FIG. 5 showing one of the counterweights in a disengaged position from the rotor hub.

The outer flange 98 also has an inwardly directed toothed ring 120 which is mateable with a toothed surface 122 cooperatively positioned on the top of the outer portion 74 of the counterweight 22. As best seen in FIG. 5, when the inner and outer portions 70, 74 of the counterweight are biased away from one another, the toothed surface 122 cooperatively engages the toothed ring 120 on the outer flange so that the counterweight 22 engages the rotor 12. It is apparent that at high rotational speeds, the engagement is enhanced and does not require the bias caused by spring 82 to maintain the engagement. However, when it is desired to change the relative positions of one or more of the counterweights with respect to the rotor hub 18, the solenoid 50 under instruction from the microprocessor 30 causes the outer portion 74 to pivot inwardly about pin 80 with respect to the inner portion 70 of the counterweight 22 so as to disengage the counterweight from rotation with the hub 18 while simultaneously engaging the counterweight 22 with the frame 17 of the instrument. The microprocessor is then free to cause the rotor 12 to rotate with respect to the counterweight 22 until the desired relative position of the counterweight with respect to the rotor is achieved. To encourage engagement of the solenoid with the counterweight 22, the outer portion 74 of the counterweight is provided with a radially-extending lip 124 at its lower end thereof which extends outwardly from the outer, downwardly directed circular flange 98. The lip 124 is provided with a pocket 126 for receiving a plunger 128 of the solenoid 50. The microprocessor knows when the plunger 128 is in postiion to register with the pocket 126 due to a signal from the sensor 54 which detects the presence of magnet 52 when it is opposite the sensor.

Each of the counterweights is moved individually by cooperative action of the solenoid 50 and angular motion of the rotor 12 under control of the microprocessor as described above.

After an assay run has been completed with one or more assay cassettes received in the cassette receptacles 14, the operator can remove the cassettes therefrom and load the instrument 10 with a new batch of cassettes. The instrument 10 will then repeat the process of: 1) spinning the rotor 12 slowly to determine the location and number of received cassettes; 2) calculating the new desired counterbalancing position for the counterweights 22; 3) rotating the rotor 12 until the sensor 54 locates one of the counterweights; 4) locating the captured counterweight with the sensor 54; 5) disengaging the counterweight from the hub 18 by actuating the solenoid 50; 6) moving the rotor with respect to the counterweight 22 while the counterweight is disengaged therefrom; and 7) releasing the counterweight by de-energizing the solenoid 50 to re-engage the counterweight with the hub 18. This process is then repeated for the other counterweight until both counterweights 22 are in their new, desired counterbalancing positions, at which time the centrifugal processing of the cassettes at high rotational speeds can proceed.

Other variations and embodiments of the invention are contemplated. For example, the specific frictional engagement mechanism of the counterweights with the rotor may be modified to a technique other than the use of toothed surfaces as will be apparent to those of ordinary skill in the art. In addition, the specific shape of the counterweights may be varied from that shown in the drawings. Therefore, the invention is not to be limited by the above description, but is to be determined in scope by the claims which follow.

I claim:

1. A self-balancing apparatus for a centrifuge comprising:

a rotatable platter having a plurality of receptacles for receiving assay cartridges;

a motor for rotating the platter about a rotation axis and motor control means for controlling operation of the motor;

a frame member for supporting the platter and motor;

platter locating means for determining the angular position of the platter with respect to the frame;

two counterweights of substantially equal mass moveably connected to the platter;

counterweight engagement/disengagement means for alternately engaging and disengaging the counterweights with the platter and the frame member;

cassette locating and counting means for determining the number and location of assay cartridges received in the receptacles; and processor means, operatively associated with the motor control means, platter locating means, counterweight engagement/disengagement means, and cassette locating and counting means for calculating a desired, counter balanced position for the counterweights with respect to the platter based upon the number and location of any received cassettes, and for directing relative movement of the counterweights and platter to the desired, counter balanced position.

2. The apparatus of claim 1, including counterweight locating means operatively associated with the processor means for locating the counterweights with respect to the frame.

3. The apparatus of claim 2, wherein the counterweight locating means includes sensor devices which indicate the presence or absence of the counterweights with respect to predetermined locations on the frame member.

4. The apparatus of claim 1, wherein the counterweight engagement/disengagement means has counterweight immobilizing mechanisms for immobilizing the counterweights with respect to the frame member while the counterweights are disengaged from the platter so that rotation of the platter by the motor causes relative angular displacement of the counterweights and the platter.

5. The apparatus of claim 4, wherein the counterweight engagement/disengagement means includes an inner, downwardly directed cylindrical flange on the platter defining an outwardly directed circumferential groove, and also includes an outer, downwardly directed cylindrical flange on the platter having an inwardly directed frictional surface, the inner and outer flanges being radially spaced apart so as to define an open-ended annular cavity therebetween, and wherein each counterweight is received in the annular cavity and has an inner portion sized to slideably ride in the groove and an outer portion pivotally connected to the inner portion and spring biased to pivot away from the inner portion, the outer portion also having an outwardly directed frictional surface for cooperative engagement with the inwardly directed frictional surface on the outer flange so that actuation of the counterweight immobilizing mechanisms pivot the outer portions towards the inner portions, thereby disengaging the frictional surfaces and allowing the platter to rotate with respect to the counterweights until the immobilizing mechanisms are deactivated.

6. The apparatus of claim 5, wherein the immobilizing mechanisms are solenoids.

7. The apparatus of claim 4, wherein the platter has an inner, downwardly directed cylindrical flange defining an outwardly directed circumferential groove, and an outer, downwardly directed cylindrical flange spaced apart from the inner flange so as to define an open ended annular cavity therebetween, and wherein each counterweight is received in the annular cavity and has an inner portion sized to slideably ride in the groove and an outer portion pivotally connected to the inner portion and spring biased to pivot away from the inner portion towards the outer flange.

8. The apparatus of claim 7, wherein the outer, downwardly directed cylindrical flange has an inwardly directed frictional surface, and wherein the outer portion of each counterweight has an outwardly directed frictional surface for cooperative engagement with the inwardly directed frictional surface on the outer flange so that actuation of the counterweight immobilizing mechanisms pivot the counterweight outer portions towards the counterweight inner portions thereby disengaging the frictional surfaces and allowing the platter to rotate with respect to the counterweights until the immobilizing mechanisms are deactivated.

9. The apparatus of claim 8, wherein the immobilizing mechanisms are solenoids.

10. The apparatus of claim 8, including guide means for guiding movement of the counterweight outer portions in the annular cavity.

11. A self-balancing apparatus for a centrifuge, comprising:

a rotatable platter having a plurality of receptacles for receiving assay cartridges;

a frame member for supporting the platter;

platter locating means for determining the angular position of the platter with respect to the frame;

two counterweights of substantially equal mass connected to and arcuately moveable with respect to the platter;

counterweight moving means for moving the counterweights with respect to the platter;

cassette locating and counting means for determining the number and location of assay cartridges received in the receptacles; and processor means, operatively associated with the platter locating means, counterweight moving means, and cassette locating and counting means for calculating a desired, counter balanced position for the counterweights with respect to the platter based upon the number and location of any received cassettes, and for directing relative movement of the counterweights and platter to the desired, counter balanced position.

12. The apparatus of claim 11, including counterweight locating means, operatively associated with the processor means for locating the counterweights with respect to the frame.

13. The apparatus of claim 12, wherein the counterweight locating means includes sensor devices which indicate the presence or absence of the counterweights with respect to predetermined locations on the frame member.

* * * * *